United States Patent [19]

Mrenna et al.

[11] 4,121,077

[45] Oct. 17, 1978

[54] CIRCUIT BREAKER HAVING IMPROVED MOVABLE CONTACT POSITION INDICATOR

[75] Inventors: Stephen A. Mrenna; Glenn R. Thomas, both of Brighton Township, Beaver County, Pa.

[73] Assignee: Westinghouse Electric Corp., Pittsburgh, Pa.

[21] Appl. No.: 811,227

[22] Filed: Jun. 29, 1977

[51] Int. Cl.[2] ..... H01H 9/16; H01H 50/06

[52] U.S. Cl. ..... 200/308; 200/153 G; 335/17; 335/20; 335/191

[58] Field of Search ..... 200/153 G, 153 L, 308; 335/17, 20, 191; 337/79

[56] References Cited

U.S. PATENT DOCUMENTS

| | | | |
|---|---|---|---|
| 969,581 | 9/1910 | Webster | 200/308 X |
| 993,946 | 5/1911 | Beechlyn | 200/308 X |
| 2,222,312 | 11/1940 | Green | 200/308 X |
| 2,376,503 | 5/1945 | Pearson | 200/308 |
| 2,854,555 | 9/1958 | Edmunds | 200/308 |
| 3,443,258 | 5/1969 | Dunham et al. | 337/79 |

FOREIGN PATENT DOCUMENTS

| | | | |
|---|---|---|---|
| 677,165 | 12/1963 | Canada | 200/308 |
| 1,043,478 | 11/1958 | Fed. Rep. of Germany | 200/308 |
| 363,707 | 9/1962 | Switzerland | 200/308 |
| 470,874 | 8/1937 | United Kingdom | 200/308 |

*Primary Examiner*—Stephen Marcus
*Attorney, Agent, or Firm*—M. S. Yatsko

[57] ABSTRACT

A circuit breaker including stationary contact means and a movable contact operable between open and closed positions with respect to the stationary contact means. A contact holder engages the movable contact, and means are utilized for effecting movement of the movable contact between the open and closed positions. Indicator means indicate the position of the movable contact with respect to the stationary contact, and may also function to reset an automatic tripping mechanism.

10 Claims, 16 Drawing Figures

CIRCUIT BREAKER HAVING IMPROVED MOVABLE CONTACT POSITION INDICATOR

CROSS-REFERENCE TO RELATED APPLICATIONS

Reference is made to the below listed copending applications which are assigned to the same assignee as the present invention.

1. "Circuit Breaker Having Insulation Barrier" by A. E. Maier et al, Ser. No. 755,765, filed Dec. 30, 1976.
2. "Stored Energy Circuit Breaker" by A. E. Maier et al, Ser. No. 755,768, filed Dec. 30, 1976.
3. "Circuit Breaker Utilizing Improved Current Carrying Conductor System" by H. A. Nelson et al, Ser. No. 755,769, filed Dec. 30, 1976.
4. "Circuit Breaker With Current Carrying Conductor System Utilizing Eddy Current Repulsion" by J. A. Wafer et al, Ser. No. 755,776, filed Dec. 30, 1976.
5. "Circuit Breaker With Dual Drive Means Capability" by W. V. Bratkowski et al, Ser. No. 755,764, filed Dec. 30, 1976.
6. "Circuit Breaker Having Improved Movable Contact" by H. A. Nelson et al, Ser. No. 755,767, filed Dec. 30, 1976.
7. "Circuit Breaker With High Speed Trip Latch" by A. E. Maier et al, Ser. No. 755,766, filed Dec. 30, 1976.
8. "Circuit Breaker Having Improved Movable Crossbar And Spring Holder" by A. E. Maier et al, Ser. No. 803,196, filed June 3, 1977.
9. "Circuit Breaker Having Opening Spring Position Indicator" by A. E. Maier et al, Ser. No. 827,038, filed Aug. 23, 1977.

BACKGROUND OF THE INVENTION

This invention relates generally to single or multi-pole circuit breakers, and more particularly to circuit breakers having an improved movable contact-position indicating means.

The basic functions of circuit breakers are to provide electrical system protection and coordination whenever abnormalities occur on any part of the system. The operating voltage, continuous current, frequency, short circuit interrupting capability, and time-current coordination needed are some of the factors which must be considered when designing a breaker. Government and industry are placing increasing demands upon the electrical industry for interrupters with improved performance in a smaller package and with numerous new and novel features.

Stored energy mechanisms for use in circuit breakers of the single pole or multi-pole type have been known in the art. A particular construction of such mechanisms is primarily dependent upon the parameters such as rating of the breaker. Needless to say, many stored energy circuit breakers having closing springs cannot be charged while the circuit breaker is in operation. For that reason, some circuit breakers have the disadvantage of not always being ready to close in a moment's notice. These circuit breakers do not have, for example, an open-close-open feature which users of the equipment find desirable.

Another problem present in some prior art circuit breakers is that associated with matching the spring torque curve to the breaker loading. These prior art breakers utilize charging and discharging strokes which are each 180°. The resulting spring torque curve is predetermined, and usually cannot be matched with the breaker loading. Such a predetermined curve mandates that the elements associated with the breaker be matched for this peak torque rather than be matched with the breaker load curve.

An additional problem present in the prior art circuit breakers is associated with the means for connecting the movable contact to one of the stationary contacts. These prior art connections generally included the use of braids or laminations which were secured to both the movable contact and one of the stationary contacts, and more particularly, the load side stationary contact. These braids are not always desirable, in that they may include some slack which could interfere with normal breaker operations.

Still another shortcoming present in the prior art breakers concerns the sizes of the breakers. It is desirable to construct the circuit breaker in as small a size as is possible while still providing the necessary features. A very desirable feature in these circuit breakers is to have indicating flags which show the position of the movable contact with respect to the stationary contact.

SUMMARY OF THE INVENTION

In accordance with this invention, it has been found that a more desirable circuit breaker is provided which comprises a stationary contact, a movable contact operable between open and closed positions with respect to the stationary contact and a movable contact holder coupled to the movable contact. Means are included for effecting movement of the movable contact between the open and closed positions, and indicator means indicate the position of the movable contact in the open and closed positions. The indicator means are operable between first and second positions, being in a first position when the movable contact is in the closed position and being in a second position when the movable contact is in the open position. The indicator means are biased in the first position, and are coupled to connection means which are operable between third and fourth positions. The connection means move the indicator means according to the position of the movable contacts, and the connection means contact the contact holder which imparts movement thereto.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
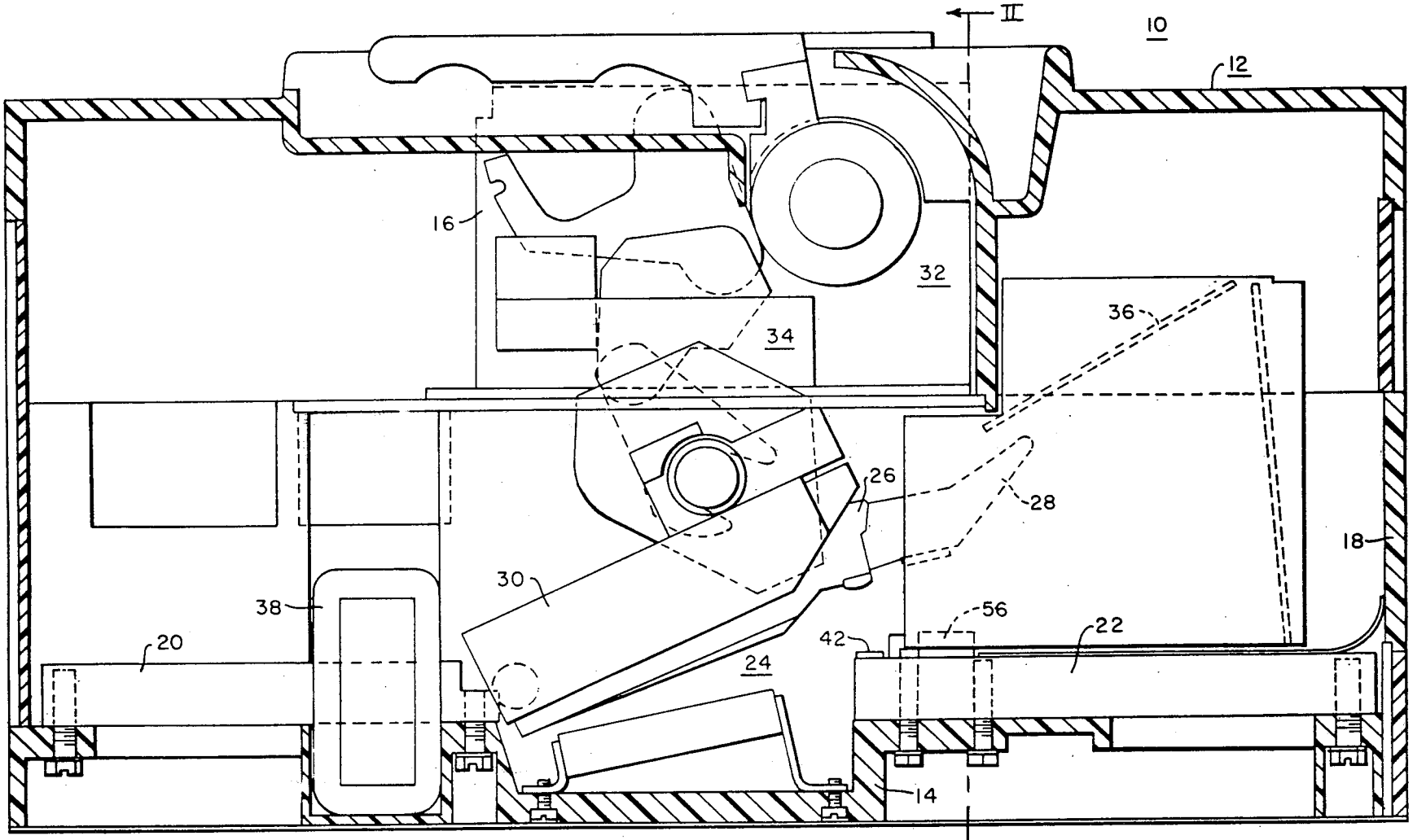
FIG. 1 is an elevational sectional view of a circuit breaker utilizing the teachings of this invention.

Referring now more particularly to FIG. 1, therein is shown a circuit breaker utilizing the teachings of this invention. Although the description is made with reference to that type of circuit breaker known in the art as a molded case, stored energy circuit breaker, it is to be understood that the invention is likewise applicable to circuit breakers or switches generally. The circuit breaker 10 includes support 12 which is comprised of a mounting base 14, side walls 16, and a frame structure 18. A pair of stationary contacts 20, 22 are disposed within the support 12. Stationary contact 22 would, for example, be connected to an incoming power line (not shown), while the other stationary contact 20 would be connected to the load (not shown). Electrically connecting the two stationary contacts 20, 22 is a movable contact structure 24. The movable contact structure 24 comprises a movable contact 26, a movable arcing contact 28, a contact carrier 30 and crossbar and spring holder 64. The movable contact 26 and the arcing contact 28 are pivotally secured to the stationary contact 20, and are capable of being in open and closed positions with respect to the stationary contact 22. Throughout this application, the term "open" as used with respect to the contact positions means that the movable contacts 26, 28 are spaced apart from the stationary contact 22, whereas the term "closed" indicates the position wherein the movable contacts 26, 28 are contacting both stationary contacts 22 and 20. The movable contacts 26, 28 are mounted to and carried by the contact carrier 30 and crossbar and spring holder 64.

Also included within the circuit breaker 10 is an operating mechanism 32, a toggle means 34, and an arc chute 36 which extinguishes any arc which may be present when the movable contacts 26, 28 change from the closed to open position. A current transformer 38 is utilized to monitor the amount of current flowing through the stationary contact 20.

Figure 12:
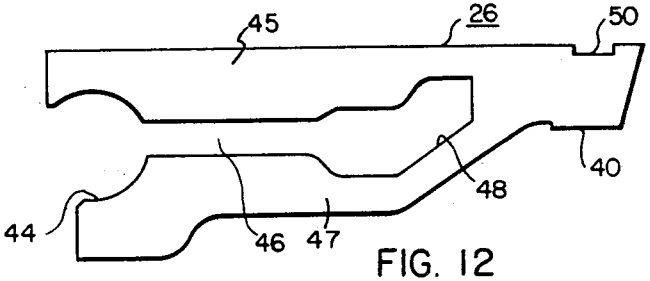
FIG. 12 is a detailed view of the movable contact.

Referring now to FIG. 12, there is shown a detailed view of the movable contact 26. The movable contact 26 is of a good electrically conducting material, such as copper or aluminum, and has a contact surface 40 which mates with a similar contact surface 42 (see FIG. 1) of stationary contact 22 whenever the movable contact 26 is in the closed position. The movable contact 26 has a circular segment 44 cut out at the end opposite to the contact surface 40, and also has a slotted portion 46 extending along the movable contact 26 from the removed circular segment 44. At the end of the slot 46 is an enlarged slot opening 48. The movable contact 26 also has a depression 50 at the end thereof opposite the contact surface 40.

Figure 10:
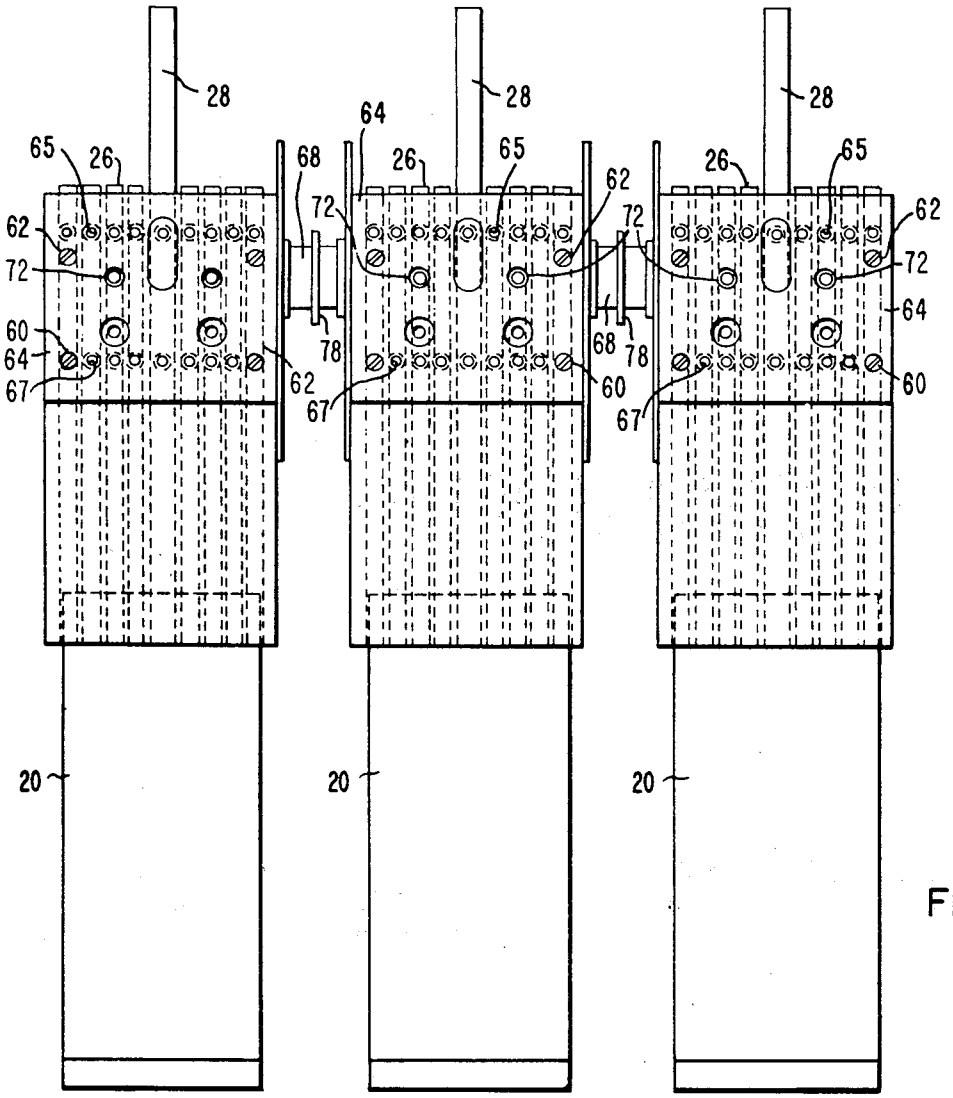
FIG. 10 a plan view of a current carrying contact system.
Figure 11:
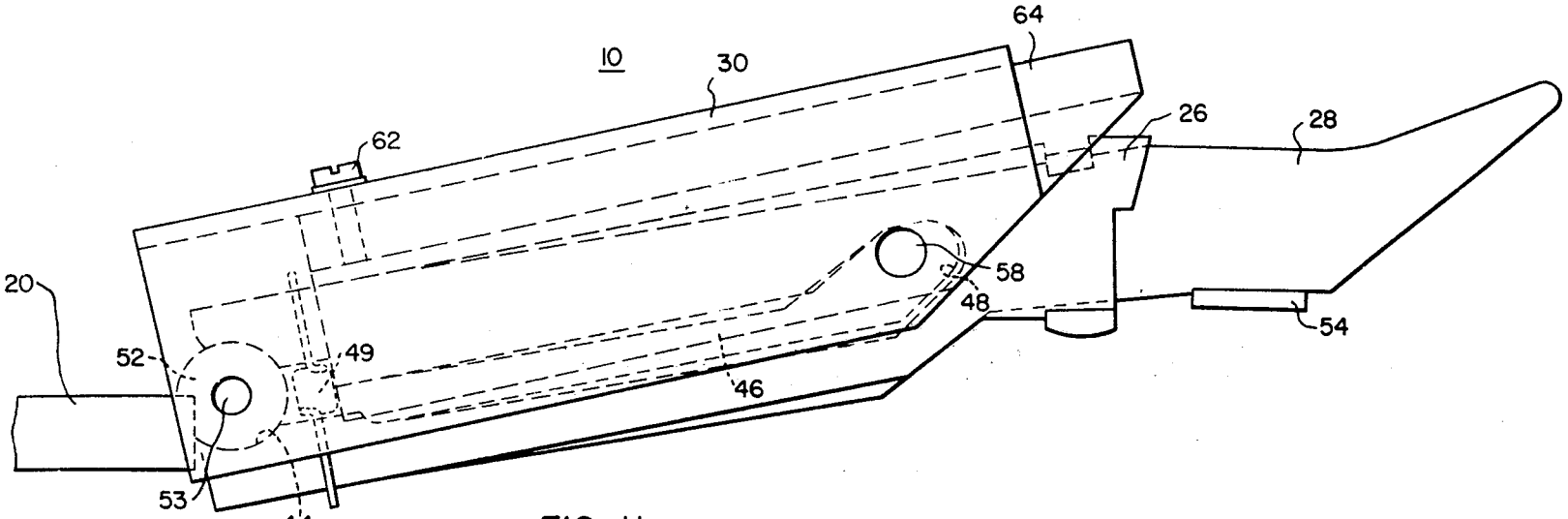
FIG. 11 is a side, sectional view of the current conducting system.

The circular segment 44 of the movable contact 26 is sized so as to engage a circular segment 52 which is part of the stationary contact 20 (see FIG. 11). The circular segment 44 and the slot 46 are utilized to clamp about the circular segment 52 to thereby allow pivoting of the movable contact 26 while maintaining electrical contact with the stationary contact 20. As shown in FIG. 11, the arcing contact 28 is designed similarly to the movable contact 26, except that the arcing contact 28 extends outwardly beyond the movable contact 26 and provides an arcing mating surface 54 which contacts a similarly disposed surface 56 on the stationary contact 22. The arcing contact 28 and the movable contact 26 are mounted to, and carried by a contact carrier 30. A pin 58 extends through the enlarged slot openings 48 in the movable contact 26 and the arcing contact 28, and this pin 58 extends outwardly to, and is secured to, the contact carrier 30. The contact carrier 30 is secured by screws 60, 62 to a crossbar and spring holder 64. The contact carrier 30 is also pivotally secured to the end segment 52 by pin 53. The crossbar and spring holder 64 is typically of a molded plastic. By so constructing the connections of the movable contact 26 to the contact carrier 30, the movable contacts 26 are permitted a small degree of freedom with respect to each other. To maintain contact pressure between the movable contact surface 40 and the stationary contact surface 42 when the movable contact 26 is in the closed position, a spring 66 is disposed within the recess 50 of the movable contact 26 and is held within the openings 65 of the crossbar and spring holder 64 (see FIGS. 10 and 13). The spring 66 resists the forces which may be tending to separate the movable contacts 26 from the stationary contact 22. As can be appreciated from the drawings, a plurality of openings 65 are present within the crossbar and spring holder 64, with a spring 66 being inserted within each opening 65 and corresponding to the movable contacts 26, 28 associated therewith.

The circular segment 44 and the slotted portion 46 of the movable contact 26 provide for increased clamping or engagement pressure whenever the movable contact 26 is in the closed position. When the movable contact 26, and more particularly the contact surface 40, is in contact with the contact surface 42 of stationary contact 22, the current flowing from the stationary contact 22 to stationary contact 20 flows through the two, parallel current conducting members 45, 47 to the circular segment 52 of the stationary contact 20. Because of the current flow from these two parallel members 45, 47, the two members 45, 47 attempt to move toward each other. This attractive force results in increased engagement pressure against the circular member 52. If desired, contact spring means 49 may be connected to the two parallel members 45, 47 to increase the clamping action of these members 45, 47 against the circular segment 52 during those periods when the current flow through the movable contact 26 is low or non-existent.

As can be appreciated by one skilled in the art, a plurality of movable contacts 26 is generally disposed within each contact carrier 30 and crossbar and spring holder 64. These additional movable contacts are similar to those heretofore described, and likewise are pivotally connected to the circular segment 52 of the stationary contact 20. The pin 58 extends through all the similar enlarged slot openings 48 in the plurality of movable contacts 26, so that all the movable contacts 26 move together whenever the contacts 26 change position from open to closed, or closed to open.

Figure 13:
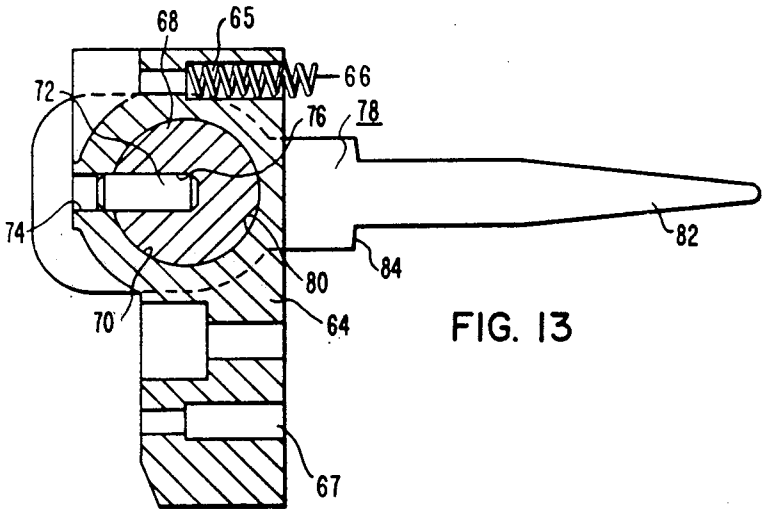
FIG. 13 is a side view of the crossbar and spring holder structure.

Also shown in FIG. 10 is a cross arm 68 which extends between the individual crossbar and spring holders 64. The cross arm 68 assures that each of the three poles illustrated will move simultaneously upon movement of the operating mechanism 32 to drive the contacts 26, 28 into closed or open position. As shown in FIG. 13, the cross arm 68 extends within an aperture 70 in the crossbar and spring holder 64. A pin 72 extends through an opening 74 in the crossbar and spring holder 64 and an opening 76 in the cross arm 68 to prevent the cross arm 68 from sliding out of the crossbar and spring holder 64. By so molding the aperture 70 in the crossbar and spring holder 64, the necessity of utilizing a plurality of small parts to secure the cross arm 68 to the crossbar and spring holder 64 is eliminated. Also attached to the cross arm 68 are pusher rods 78. The pusher rods 78 have an opening 80 therein, and the cross arm 68 extends through the pusher rod opening 80. The pusher rod 78 has a tapered end portion 82, and a shoulder portion 84. The pusher rod 78, and more particularly the tapered portion 82 extend into openings 86 within the breaker mounting base 14, (see FIG. 2) and disposed around the pusher rods 78 are springs 88. These springs 88 function to exert a force against the shoulder 84 of the pusher rod 78, thereby biasing the cross arm 68 and the movable contacts 26 in the open position. To close the movable contacts 26, it is necessary to move the cross arm 68 such that the pusher rods 78 will compress the spring 88. This movement is accomplished through the operating mechanism 32 and the toggle means 34.

Figure 2:
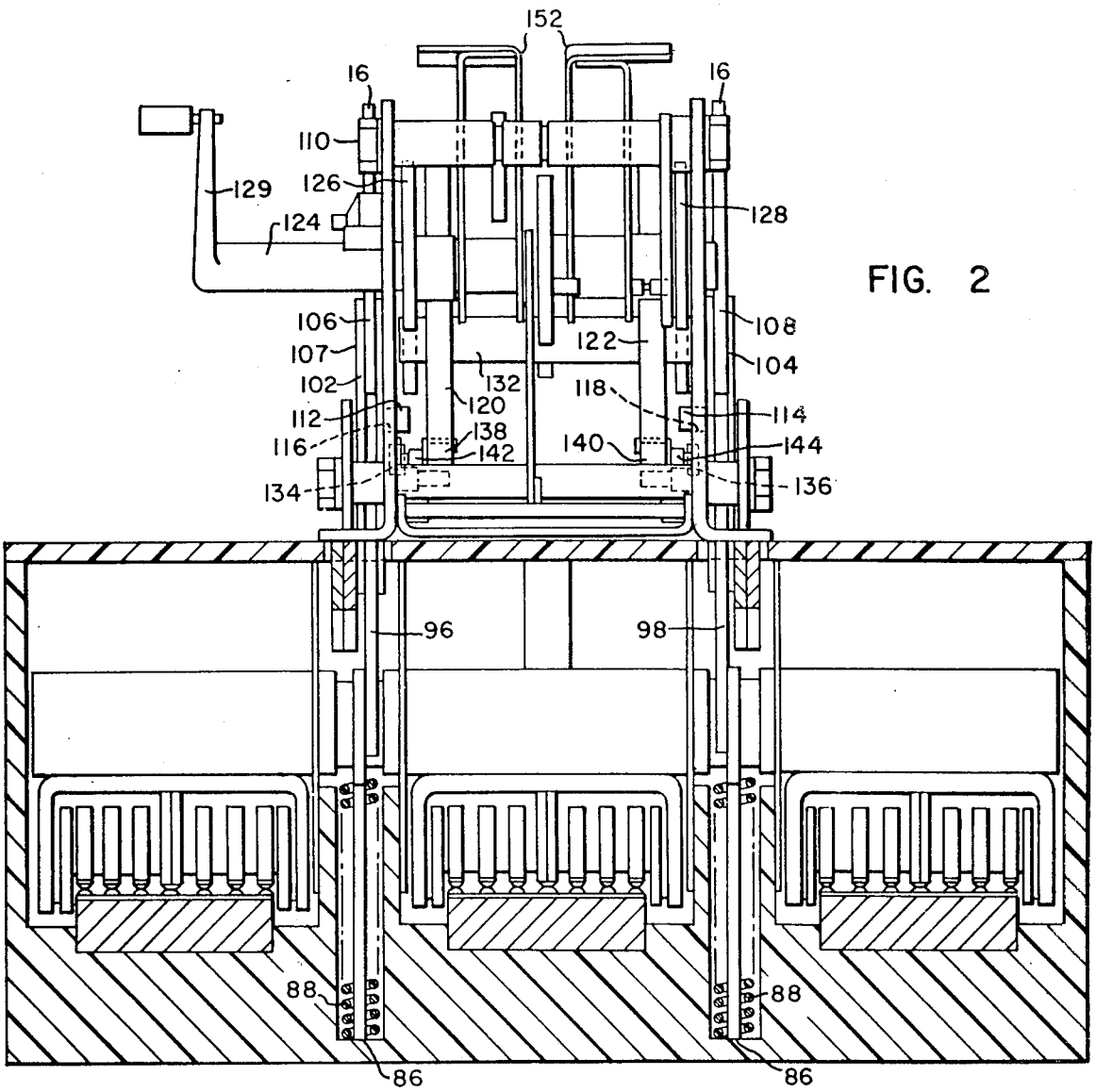
FIG. 2 is an end view taken along line II—II of FIG. 1.
Figure 14:
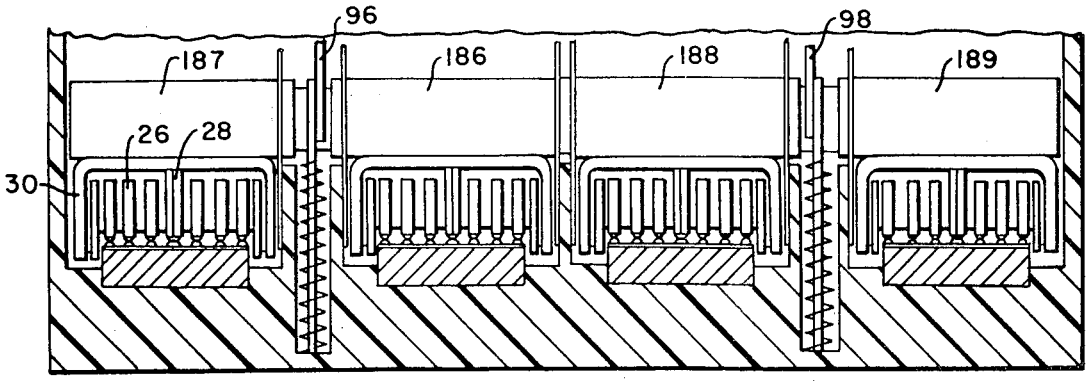
FIG. 14 is a modification of the multi-pole contact structure.
Figure 3:
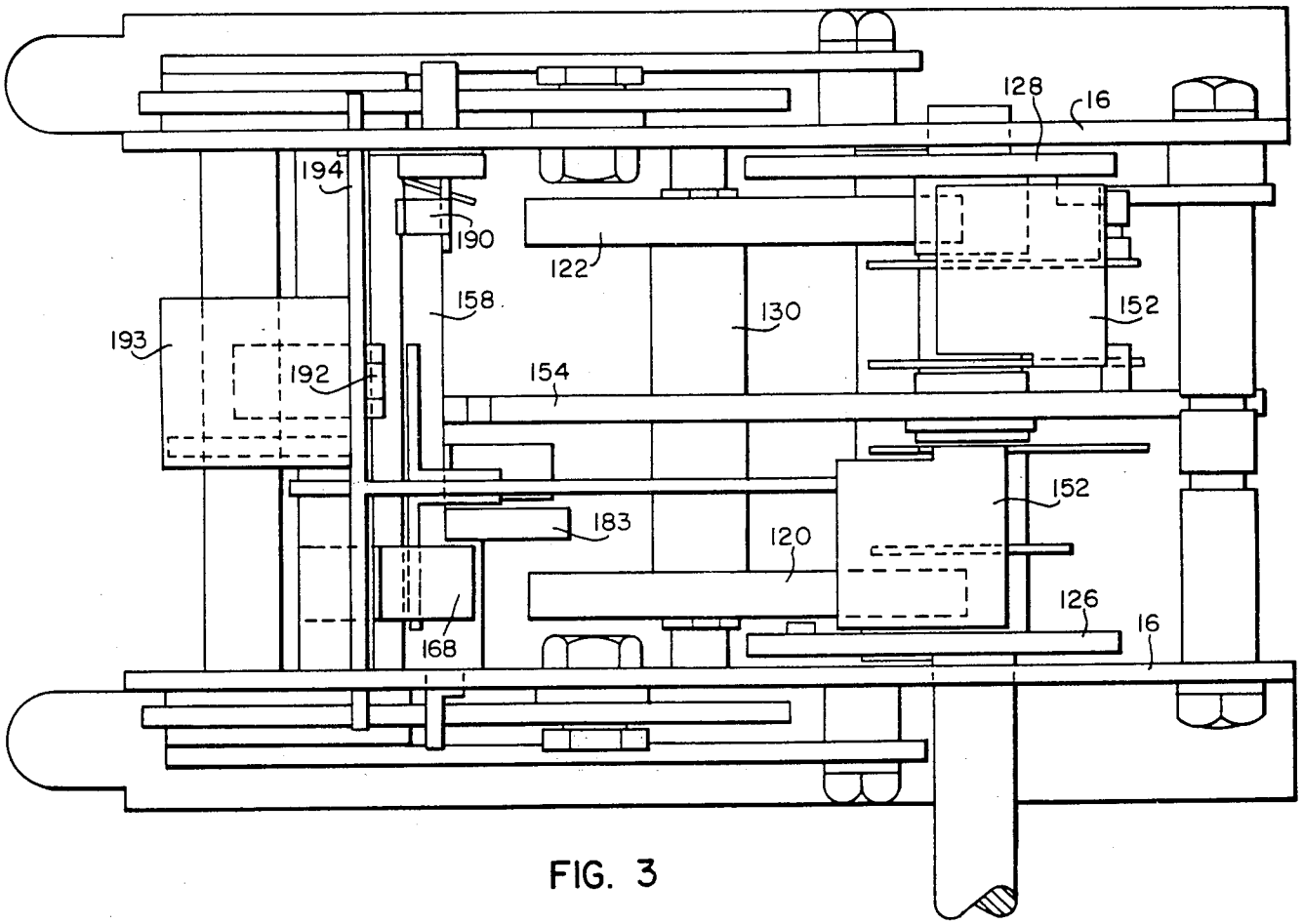
FIG. 3 is a plan view of the mechanism illustrated in FIG. 4.
Figure 4:
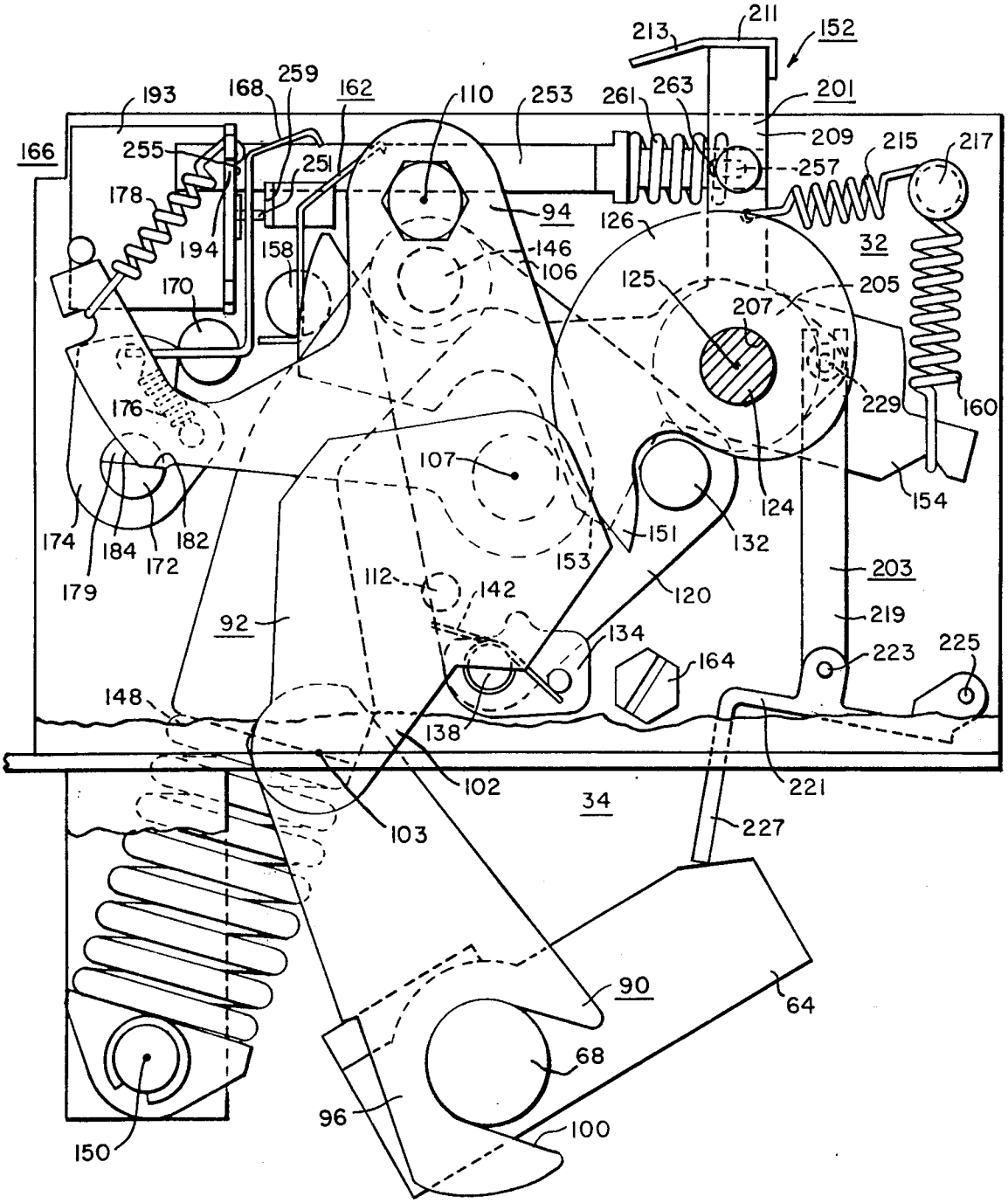
FIG. 4 is a detailed sectional view of the operating mechanism of the circuit breaker in the spring discharged, contact open position.

Referring now to FIGS. 2–4, there is shown the toggle means 34 and the operating mechanism 32. The toggle means 34 comprise a first link 90, a second link 92, and a toggle latch lever 94. The first link 90 is comprised of a pair of spaced apart first link elements 96, 98, each of which has a slot 100 therein. The first link elements 96, 98 and the slot 100 engage the cross arm 68 intermediate the three crossbar and spring holders 64, and provide movement of the cross arm 68 upon the link 90 going into toggle position. The location of the link elements 96, 98 intermediate the crossbar and spring holders 64 reduces any deflection of the cross arm 68 under high short circuit forces. Also, the use of the slot 100 for connection to the cross arm 68 provides for easy removal of the operating mechanism 32 from the cross arm 68. The connection of the toggle means 34, and more particularly the link elements 96, 98 directly to the cross arm 68 results in a smaller overall circuit breaker while still maintaining the kinematic function and electrical isolation of the operating mechanism 32 and the movable contacts 26, 28. Although described with respect to the three-pole breaker illustrated in FIG. 2, it is to be understood that this description is likewise applicable to the four-pole breaker illustrated in FIG. 14. With this four-pole breaker, the first link elements 96, 98 are disposed between the interior contact holders 186, 188 and the exterior holders 187, 189. Also, if desired, an additional set of links or additional springs (not shown) may be disposed between the interior holders 186, 188.

The second link 92 comprises a pair of spaced-apart second link elements 102, 104 which are pivotally connected to the first link elements 96, 98, respectively at pivot point 103. The toggle latch lever 94 is comprised of a pair of spaced-apart toggle lever elements 106, 108 which are pivotally connected to the second link elements 102, 104 at pivot point 107, and the toggle latch lever elements 106, 108 are also pivotally connected to side walls 16 at pivotal connection 110. Fixedly secured to the second link elements 102, 104 are aligned drive pins 112, 114. The drive pins 112, 114 extend through aligned openings 116, 118 in the side walls 16 adjacent to the follower plates 120, 122.

The operating mechanism 32 is comprised of a drive shaft 124 rotatable about its axis 125 having a pair of spaced apart aligned cams 126, 128 secured thereto. The cams 126, 128 are rotatable with the drive shaft 124 and are shaped to provide a constant load to the turning means 129. Turning means such as the handle 129 may be secured to the drive shaft 124 to impart rotation thereto. The operating mechanism 32 also includes the follower plates 120, 122 which are fixedly secured together by the follower plate connector 130 (see FIG. 3). Fixedly secured to the follower plates 120, 122 is a cam roller 132, which also functions in latching the follower plates 120, 122 in the charged position, as will be hereinafter described. Also secured to each follower plate 120, 122 is a drive pawl 134, 136, respectively, which is positioned adjacent to the drive pins 112, 114. The drive pawls 134, 136 are pivotally secured to the follower plates 120, 122 by pins 138, 140, and are biased by the springs 142, 144.

The follower plates 122, 124 are also connected by a connecting bar 146 which extends between the two follower plates 120, 122, and pivotally connected to the connecting bar 146 are spring means 148. Spring means 148 is also pivotally connected to the support 12 by connecting rod 150. Indicating apparatus 152, 153 (see FIG. 2) is incorporated within the breaker 10 to display the positions of the contacts 26, 28 and the spring means 148, as will hereinafter be described.

Figure 5:
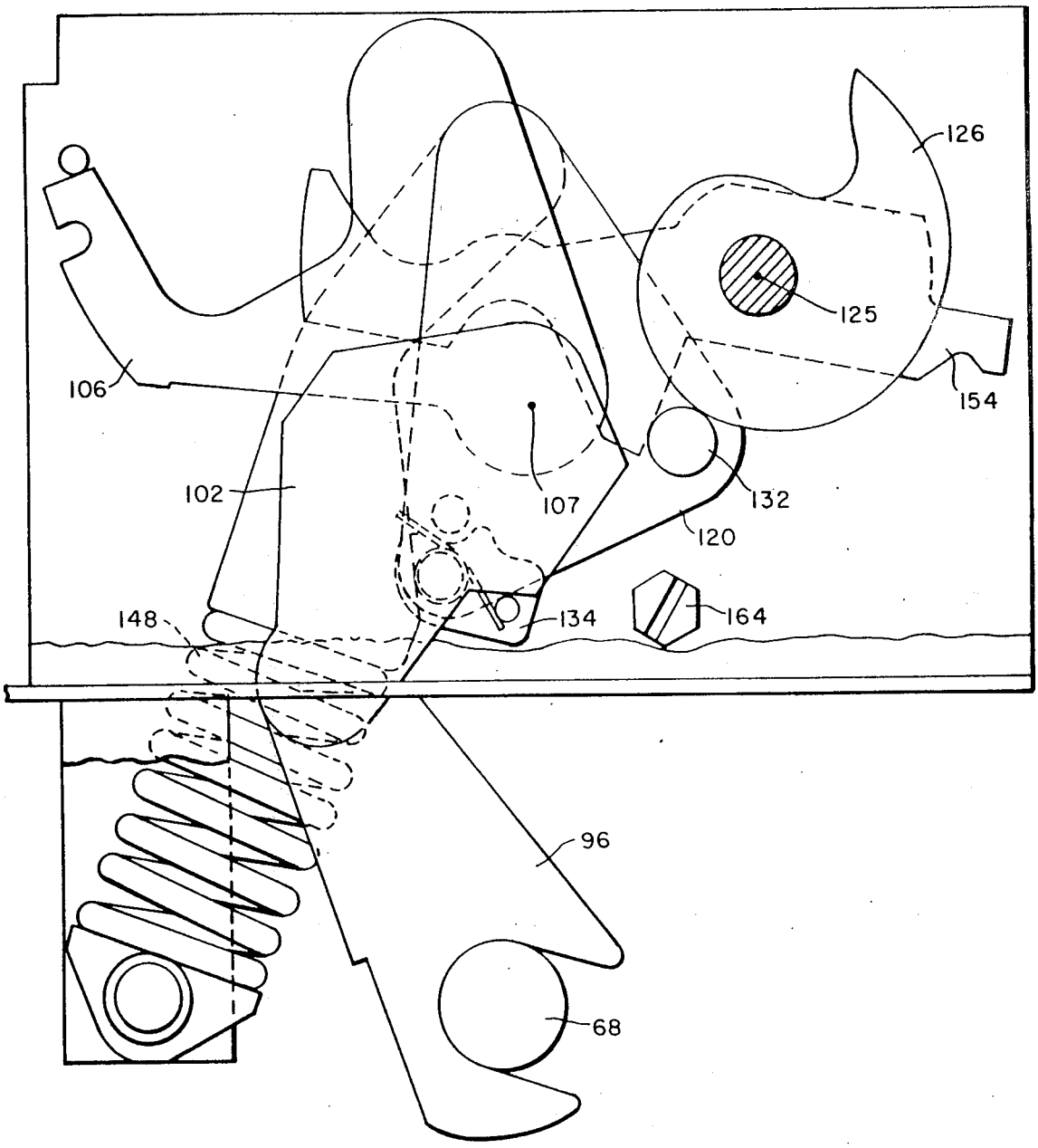
FIG. 5 is a modification of a view in FIG. 4 with the spring partially charged and the contact in the open position.

The operation of the circuit breaker can be best understood with reference to FIGS. 3–9. FIGS. 4–9 illustrate, in sequence, the movement of the various components as the circuit breaker 10 changes position from spring discharged, contact open, to spring charged, contact closed positions. In FIG. 4, the spring or springs 148 are discharged, and the movable contact 26 is in the open position. Although the contacts 20, 22, and 26, 28 are not illustrated in FIGS. 4–9, the cross arm 68 to which they are connected is illustrated, and it is to be understood that the position of the cross arm 68 indicates the position of the movable contact 26 with respect to the stationary contact 22. To begin, the drive shaft 124 is rotated in the clockwise direction by the turning means 129. As the drive shaft 124 rotates, the cam roller 132 which is engaged therewith, is pushed outwardly a distance equivalent to the increased diameter portion of the cam. FIG. 5 illustrates the position of the elements once the cam 126 has rotated about its axis 125 approximately 180° from its initial starting position. As can be seen, the cam roller 132 has moved outwardly with respect to its initial position. This movement of the cam roller 132 has caused a rotation of the follower plate 120 about its axis 107, and this rotation has stretched the spring 148 to partially charge it. Also to be noted is that the drive pawl 134 has likewise rotated along with the follower plate 120. (The preceding, and all subsequent descriptions of the movements of the various components will be made with respect to only those elements viewed in elevation. Most of the components incorporated within the circuit breaker preferably have corresponding, identical elements on the opposite side of the breaker. It is to be understood that although these descriptions will not mention these corresponding components, they behave in a manner similar to that herein described, unless otherwise indicated.)

Figure 6:
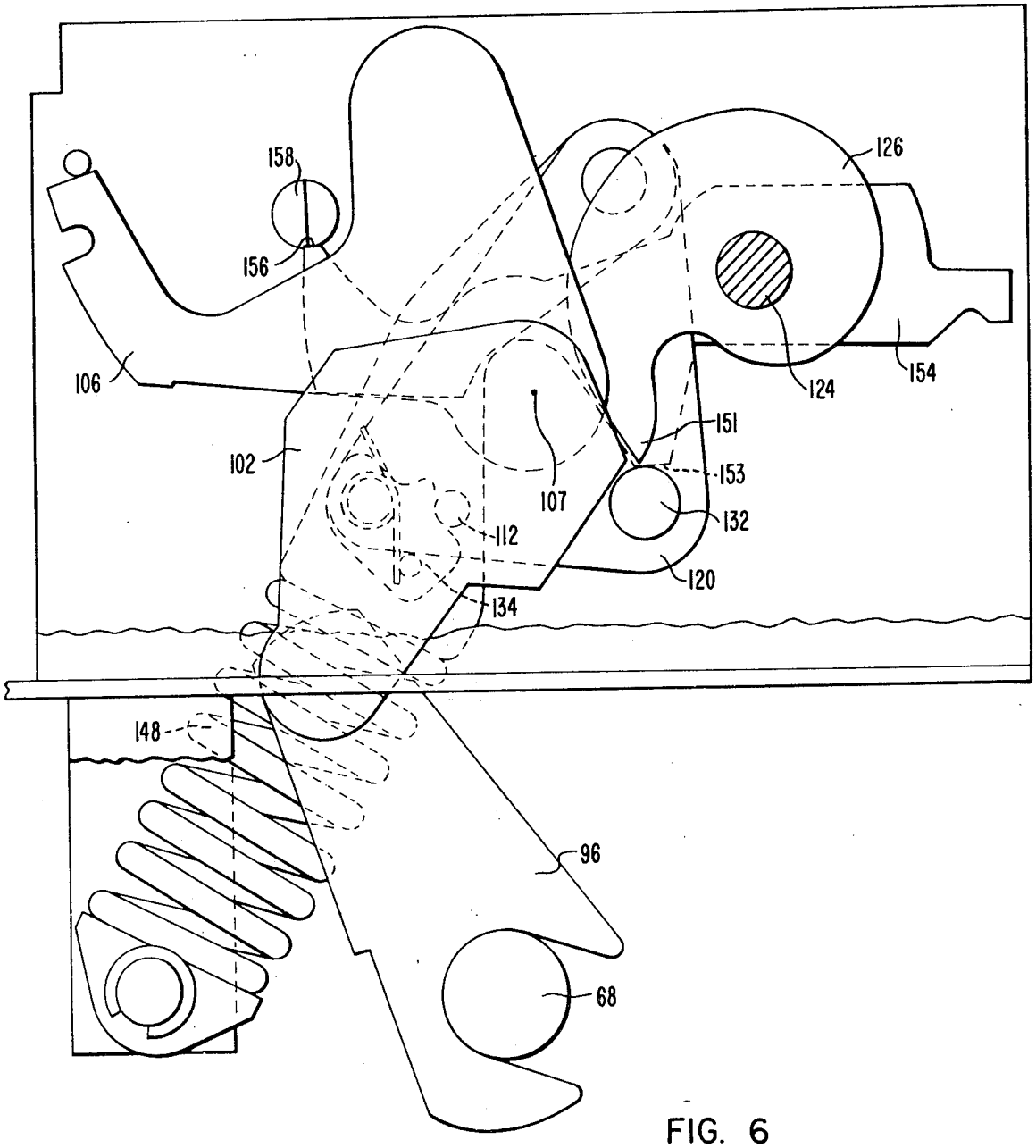
FIG. 6 is a modification of the views illustrated in FIGS. 4 and 5 with the spring charged and the contact open.
Figure 7:
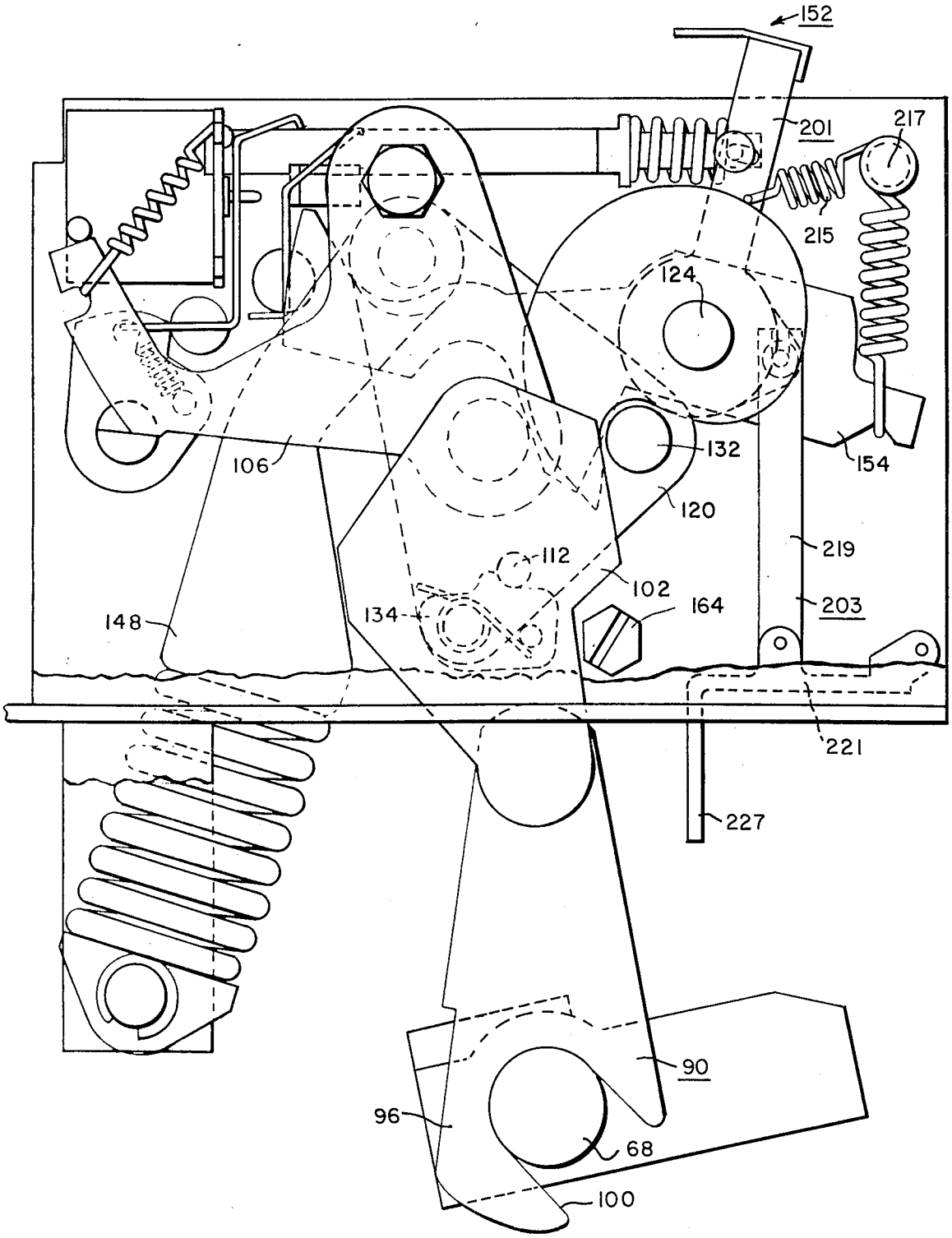
FIG. 7 is a modification of the view of FIGS. 4, 5, and 6 in the spring discharged, contact closed position.

FIG. 6 illustrates the position of the components once the cam 126 has further rotated. The cam roller 132 has traveled beyond the end point 151 of the cam 126, and has come into contact with a flat surface 153 of a latch member 154. The follower plate 120 has rotated about its axis 107 to its furthest extent, and the spring 148 is totally charged. The drive pawl 134 has moved to its position adjacent to the drive pin 112. The latch member 154, at a second flat surface 156 thereof has rotated underneath the curved portion of a D-latch 158. In this position, the spring 148 is charged and would cause counterclockwise rotation of the follower plate 120 if it were not for the latch member 154. The surface 153 of latch member 154 is in the path of movement of the cam roller 132 as the cam roller 132 would move during counterclockwise rotation of the follower plate 120. Therefore, so long as the surface 153 of the latch member 154 remains in this path, the cam roller 132 and the follower plate 120 fixedly secured thereto cannot move counterclockwise. The latch member 154 is held in its position in the path of the cam roller 132 by the action of the second surface 156 against the D-latch 158. The latch member 154 is pivotally mounted on, but independently movable from, the drive shaft 124 (see FIGS. 2 and 3), and is biased by the spring 160. The force of the cam roller 132 is exerted against the surface 153 and, if not for the D-latch 158, would cause the latch member 154 to rotate about the drive shaft 124 in the clockwise direction to release the roller 132 and discharge the spring 148. Therefore, the D-latch 158 prevents the surface 156 from moving in a clockwise direction which would thereby move the first surface 153 out of the path of movement of the cam roller 132 upon rotation of the follower plate 120. To release the latch member 154, the releasable release means 162 are depressed, which causes a clockwise rotation of D-latch 158. The clockwise movement of the D-latch 158 disengages from the second surface 56 of the latch member 154, and the latch member 154 is permitted to rotate clockwise, resulting in the movement of the first surface 153 away from the path of the cam roller 132. The results of such release are shown in FIG. 7.

Once the latch member 154 is released, the spring 148 discharges, causing rotation of the follower plate 120 about its pivot axis 107. The rotation of the follower plate 120 moves the cam roller 132 into its position at the smallest diameter portion of the cam 126. At the same time, the rotation of the follower plate 120 causes the drive pawl 134 to push against the drive pin 112. This pushing against the drive pin 112 causes the drive pin 112, and the second link element 102 to which it is connected to move to the right as illustrated in the drawing. This movement causes the second link element 102 and the first link element 96 to move into toggle position with the toggle latch lever element 106. This movement into the toggle position causes movement of the cross arm 68, which compresses the shoulder 84 of the pusher rod 78 against the springs 88, (see FIG. 2) and moves the movable contacts 26 into the closed position in electrical contact with the stationary contact 22. The movable contact 26 will remain in the closed position because of the toggle position of the toggle means 34. Once the toggle means 34 are in toggle position, they will remain there until the toggle latch lever 94 is released. As can be noticed from the illustration, the drive pawl 134 is now in its original position but adjacent to the drive pin 112. The first link 90 and the second link 92 are limited in their movement as they move into toggle position by the limiting bolt 164. This bolt 164 prevents the two links 90, 92 from knuckling over backwards and moving out of toggle position. (Throughout this application, the term "toggle position" refers to not only that position when the first and second links are in precise alignment, but also includes the position when they are slightly over-toggled.) The status of the breaker at this position is that the spring 148 is discharged, and the contacts 26 are closed.

Figure 8:
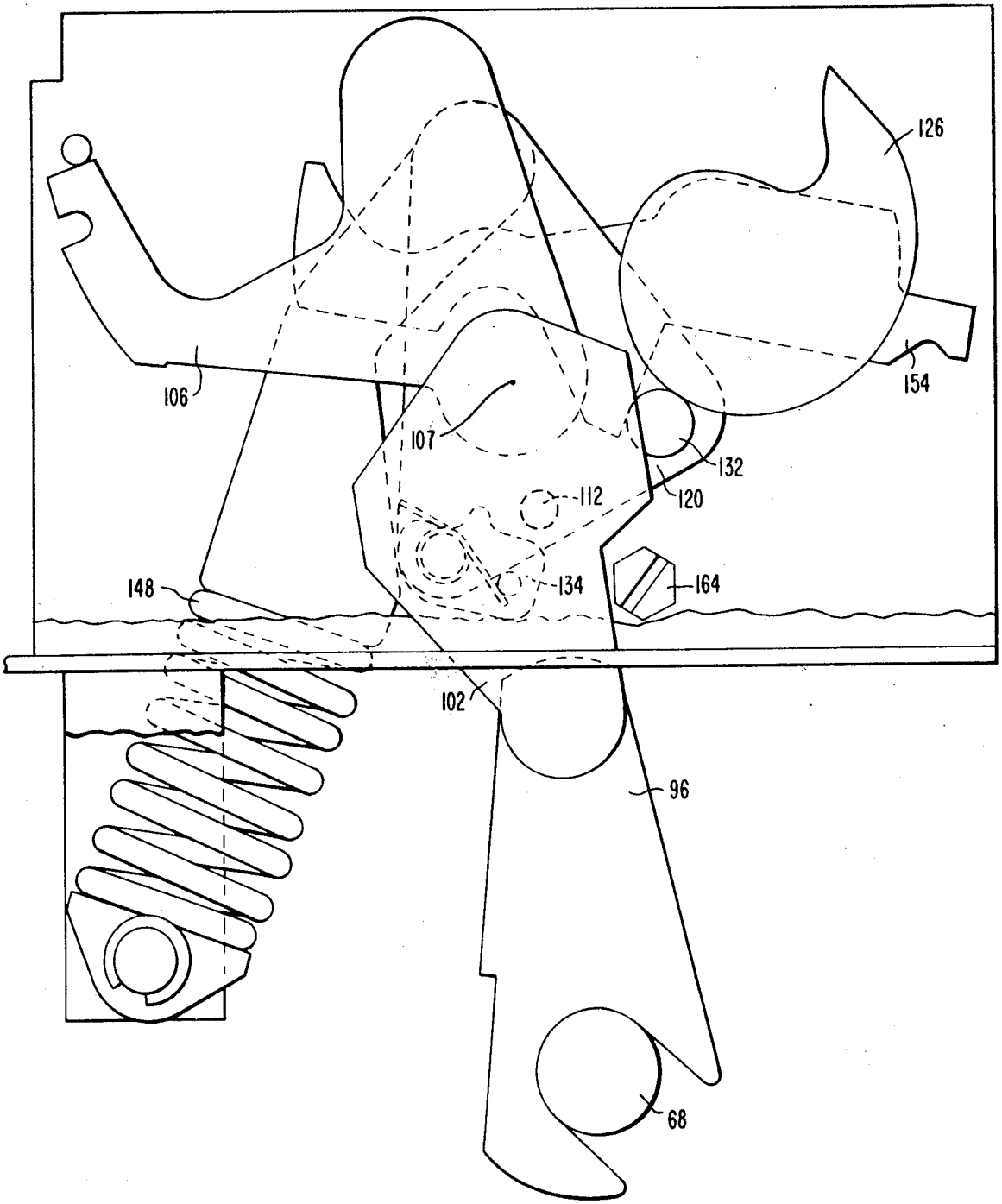
FIG. 8 is a modification of the view of FIGS. 4, 5, 6, and 7 with the spring partially charged and the contact closed.
Figure 9:
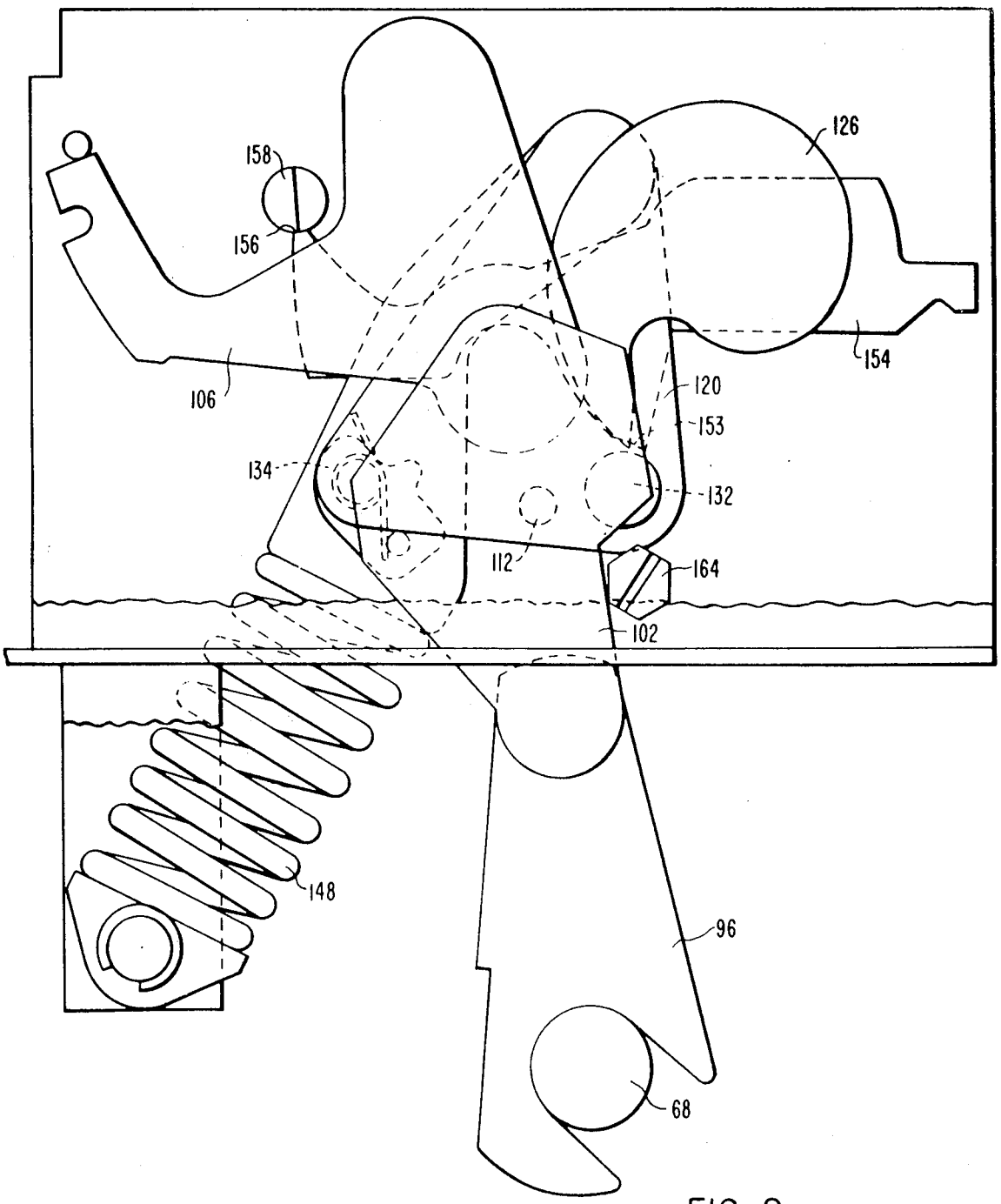
FIG. 9 is a modification of the view of FIGS. 4, 5, 6, 7, and 8 with the spring charged and the contact closed.

FIG. 8 then illustrates that the spring 148 can be charged while the contacts 26 are closed, to thereby store energy to provide an open-close-open series. FIG. 8 is similar to FIG. 5, in that the cam 126 has been rotated approximately 180°, and the follower plate 120 has rotated about its pivot point 107 to partially charge the spring 148. Again, the drive pawl 134 has rotated with the follower plate. FIG. 9 illustrates the situation wherein the spring 148 is totally charged and the contacts 26 are closed. The drive pawl 134 is in the same position it occupied in FIG. 6, except that the drive pin 112 is no longer contacted with it. The latch member 154 and more particularly the surface 153, is in the path of the cam roller 132 to thereby prevent rotation of the follower plate 120. The second surface 156 is held in its location by the D-latch 158 as previously described. In this position, it can be illustrated that the mechanism is capable of an open-close-open series. Upon release of the toggle latch release means 166, the toggle latch lever 94 will no longer be kept in toggle position with links 90 and 92, but will instead move slightly in the counterclockwise direction. Upon counterclockwise movement of the toggle latch lever 94, the second link 92 will move in the clockwise direction, pivoting about the connection with the toggle latch lever 94, and the first link 90 will move in the counterclockwise direction with the second link 92. Upon so moving out of toggle, the force on the cross arm 68 which pushed the pusher rod 78 against the spring 88 will be released, and the release of the spring 88 will force the cross arm 68 and the movable contacts 26 into the open position. This then is the position of the components as illustrated in FIG. 6. To then immediately close the contacts 26, the latch member 154 is released, which, as previously described, causes rotation of the follower plate 120 such that the drive pawl 134 contacts the drive pin 112 to cause movement of the drive pin 112 and the second link element 102 to which it is fixedly secured to move back into toggle position. This then results in the position of the components as illustrated in FIG. 7. The breaker 10 then can immediately be opened again by releasing the toggle latch release means 166, which will position the components to the position illustrated in FIG. 4. Thus it can be seen that the mechanism permits a rapid open-close-open series.

Figure 15:
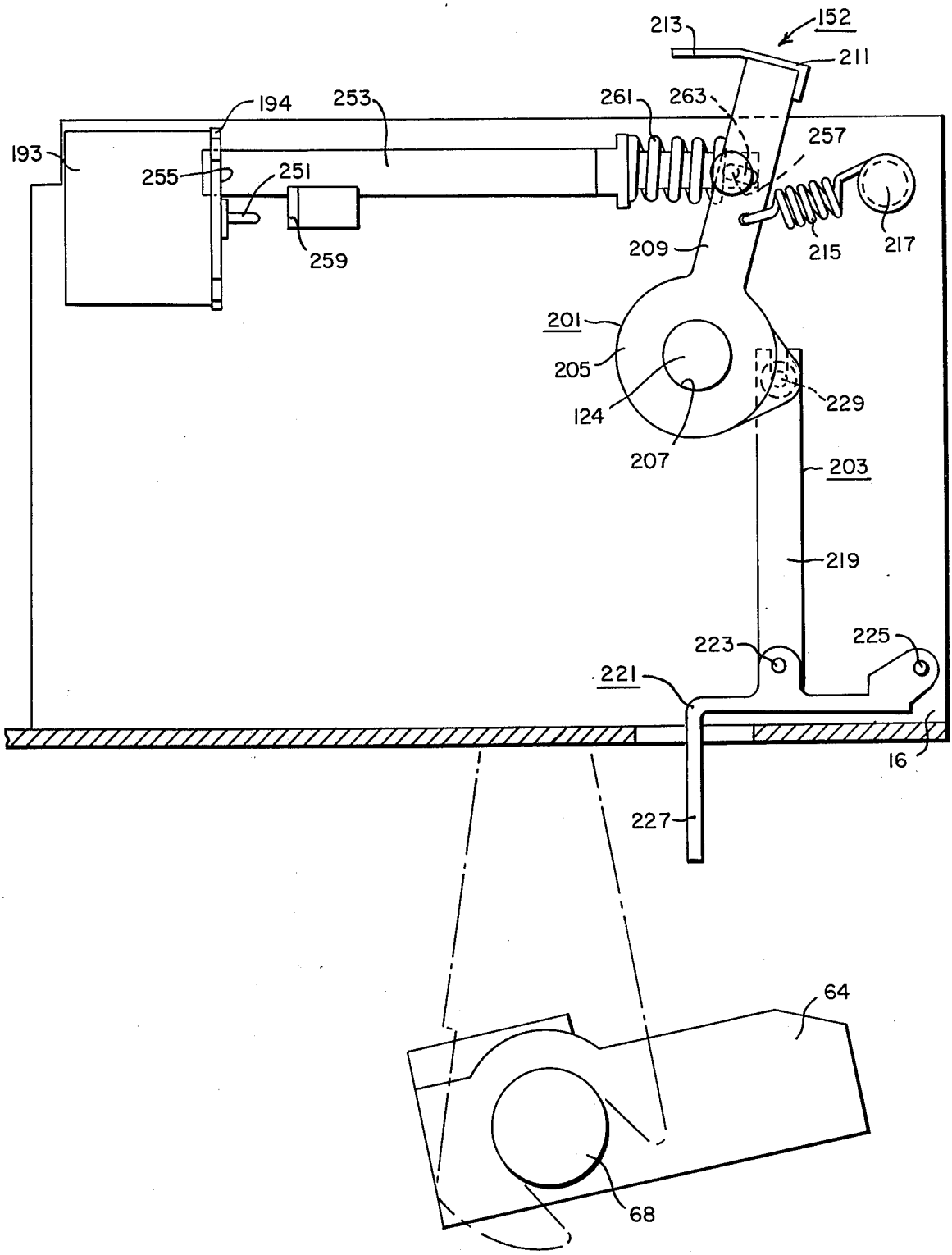
FIG. 15 is a detailed view of the movable contact position indicating system when the movable contact is in the closed position.
Figure 16:
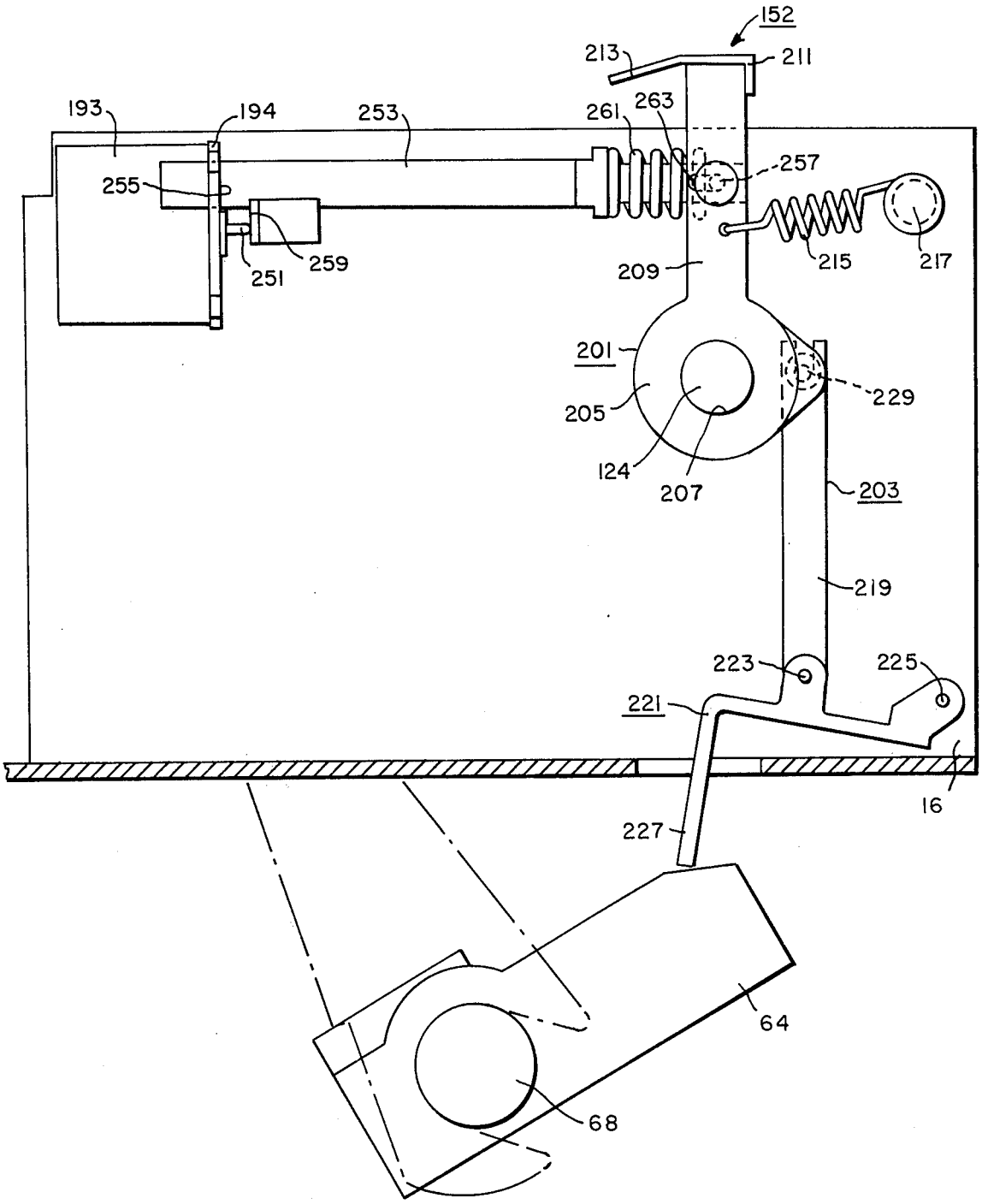
FIG. 16 is a detailed view of the movable contact position indicating system with the movable contact in the open position.

As the movable contacts 26 move between the open and closed positions, it is very desirable to provide an indication of the position of the contacts 26. The indicating means 152 are utilized to indicate the position of the movable contacts 26, 28. In FIGS. 15 and 16, there is illustrated the indicator apparatus 152, in FIG. 15 with the contact 26 closed and in FIG. 16 with the contacts 26 open. Referring now to these Figures, and more particularly FIG. 15, therein it is shown that the indicating apparatus 152 is comprised of an indicating means 201 and a connection means 203. The indicating means 201 is comprised of a central member portion 205 which has an opening 207 therein, an arm portion 209 secured to the central member portion 205, and two indicator flags 211, 213. The indicator flag 211 would, for example, have inscribed thereon a legend corresponding to contacts open, while the flag 213 would have inscribed thereon a legend corresponding to contacts closed. The indicator means 201, for compactness, would typically be mounted on, but independently rotatably from, the drive shaft 124. The indicator means 201 are pivotably operable between first and second positions, as illustrated in FIGS. 15 and 16. In FIG. 15, the position of the indicator means 201 corresponds to the position of the movable contacts 26, and more particularly the contact holder 64, when the movable contacts 26 are in the closed position. In FIG. 16, the indicator means 201 have pivoted to the left, as illustrated in the drawings, and this position corresponds to the movable contacts 26 being in the open positin. Biasing the indicator means 201 in the first position, when the contacts 26 are closed, is the return bias spring 215. This return bias spring 215 would be secured to the arm 209, and to the side wall 16 by, for example, the pin 217.

Moving the indicator means 201 between the two positions are the connection means 203. The connection means likewise are movable between two positions; a first position when the contacts 26 are closed, and a second position where the contacts 26 are open. The connection means 203 is comprised of a link member 219, an arm member 221 pivotally connected to the link member 219 by the pin 223, and the arm is likewise pivotally connected to the sidewall 16 by the pin 225. The arm member 221, and more particularly the angled extension 227 thereof, is capable of engaging the contact holder 64 whenever the holder 64, and more particularly the movable contacts 26, is in the open position, as illustrated in FIG. 16. The link member 219 likewise is pivotally connected to the central member portion 205 of the indicating means 201 by the pin 229.

The operation of the indicating means is as follows, with reference to FIGS. 15 and 16 sequentially. With the contacts in the closed position, the arm 221 of the connection means 203 is spaced apart from the contact holder 64, but is connected to the indicating means 201 at the pin 229. The biasing spring 215 is forcing the indicating means 201 into the first position, indicating that the contacts are closed. This biasing of the indicator means 201 in the contacts closed position has likewise forced the connection means 203 into its present location. However, as the contacts 26 move from closed to open, the contact holder 64 engages the arm 221 of the connection means, causing it to pivot about the pin 225 and move generally upwardly, as illustrated in the drawing. The upward movement of the arm 221 causes a corresponding upward movement of the link member 219, which causes a pivotal movement of the indicating means 201 about the drive shaft 124. The pivotal movement of the indicating means 201 causes it to move to the second position, wherein the flag 211, which typically would show through a window (not shown), would indicate to any observer that the contacts are now in the open position. This movement of the indicating means 201 from the position illustrated in FIG. 15 to that illustrated in FIG. 16 causes a stretching of the spring 215, which is attempting to return the indicator means 201 to its initial position. It is prevented from this return, however, because of the linkage through the link member 219 and the arm 221 which are engaging the contact holder 64. Upon movement of the movable contact to the closed position, the holder 64 no longer prevents downward movement of the connection means 203, which are then free to move downward as the return bias spring 215 causes the indicating means 201 to return to its initial position.

In the preferred embodiment illustrated, the positions of the various components have been determined to provide for the most economical and compacted operation. The input shaft 124 to the operating mechanism 32 is through a rotation of approximately 360°. However, the output torque occurs over a smaller angle, thereby resulting in a greater mechanical advantage. As can be seen from the sequential illustration, the output torque occurs over an angle of less than 90°. This provides a mechanical advantage of greater than 4 to 1. For compactness and maximum efficiency, the pivotal connection of the second link 92 to the toggle latch lever 94 is coincident with, but on separate shafts from, the rotational axis of the follower plates 120, 122. The toggle means 34 is directly connected to the cross arm 68 which causes movement of the movable contacts 26, 28, resulting in increased compactness of the unit. Another mechanical advantage is present in the toggle latch release means 166 when it is desired to release the toggle means 34 from toggle position.

The toggle latch release means 166 are illustrated in FIGS. 3 and 4. The toggle latch release means 166 are comprised of the latch member release lever 168, the two D-latches 170 and 172, the catch 174, biasing springs 176 and 178 and the stop pin 180. To release the toggle means 34, the latch member release lever 168 is depressed. The depressing of this lever 168 causes a clockwise rotation of the D-latch 170. The catch 174 which had been resting on the D-latch 170 but was biased for clockwise rotation by the spring 176 is then permitted to move clockwise. The clockwise movement of the catch 174 causes a corresponding clockwise movement of the D-latch 172 to whose shaft 179 the catch 174 is fixedly secured. The clockwise movement on the D-latch 172 causes the toggle latch lever 94, and more particularly the flat surface 182 upon which the D-latch 172 originally rested, to move, such that the surface 184 is now resting upon the D-latch 172. This then allows the toggle latch lever 94 to move in a counterclockwise direction, thereby releasing the toggle of the toggle means 34. After the toggle means 34 have been released, and the movable contact 26 positioned in the open position, the biasing spring 178 returns the toggle latch lever 94 to its position wherein the surface 182 is resting upon the D-latch 172. To prevent the toggle latch lever 94 from moving too far in the clockwise direction, the stop pin 180 is utilized to stop the toggle latch lever 94 at its correct location. The mechanical advantage in this release system occurs because of the very slight clockwise rotation of the D-latch 172 which releases the toggle latch lever 94 as compared to the larger rotation of the latch release lever 168.

As can be seen in FIG. 3, the D-latches 170 and 158 are attached to two levers each. Levers 183 and 190 are secured to D-latch 158, and levers 168 and 192 are secured to D-latch 170. The extra levers 190 and 192, are present to permit electromechanical or remote tripping or closing of the breaker. An electromechanical flux transfer shunt trip 193 may be secured to the frame 194 and connected to the current transformer 38 so that, upon the occurrence of an overcurrent condition, the flux transfer shunt trip 193 will move lever 192 in the clockwise direction to provide release of the toggle latch lever 94 and opening of the contacts 24. The electromechanical flux transfer shunt trip 193 typically would have included therein resetting means which are required to be reset before the shunt trip 193 may be reactivated after it has once operated. This resetting of the reset mechanism of the shunt trip 193 can utilize the indicating apparatus 152 previously described. Referring now to FIGS. 15 and 16, therein it is shown that the flux transfer shunt trip 193 typically will have a reset button 251 which extends outwardly from the shunt trip 193 upon activation of the shunt trip 193 to release the lever 192 to release the toggle latch lever 94 and open the contacts 26. This reset button 251 must be pushed to activate the reset mechanism (not shown) within the shunt trip 193 so that the shunt trip 193 may be reactivated. Accomplishing this pushing of the reset button 251 is the reset bracket 253. The reset bracket 253 slides, at one end thereof, through an opening 255 in the frame 194, and is connected to the arm member 209, and more particularly a pin 257 fixedly secured thereto. The reset bracket 253 has extensions 259 extending outwardly therefrom, and these extensions are capable of engaging the reset button 251.

The movement of the reset bracket 253 occurs as follows. As the indicator means 201 moved from the first to second positions to indicate the change of position of the movable contacts 26 from closed to open, the pin 257 likewise moves to, as illustrated in the drawings, the left. This movement causes a corresponding movement of the reset bracket 253 to the left, and this movement forces the extension 259 against the reset button 251 to thereby push it and reset the reset mechanism of the shunt trip 193. As the movable contacts move from open to closed, the pin 257 to which the reset bracket 253 is connected causes the reset bracket 253 to move to the right as the pin 257 and the indicator means 201 move pivotally toward the right. A preloaded compression spring 261 is disposed on the reset bracket 253 and provides the necessary connection of the bracket 253 to the pin 257 so as to allow reciprocal motion of the bracket 253 upon the pivotal movement of the pin 257. An oblong slot 263 is provided in the reset bracket 253 to take up overtravel and allow the spring 261 to compress if the reset button 251 is solidly extending. This might occur, for example, upon the continued occurrence of an overload condition so that the shunt trip 193 is not permitted to be reset.

An electrical solenoid device may be positioned on the frame 194 adjacent to lever 190 so that the remote pushing of a switch (not shown) will cause rotation of lever 190 causing rotation of D-latch 158 and discharging of the spring 148 to thereby close the breaker.

Accordingly, the device of the present invention achieves certain new and novel advantages resulting in a compact and more efficient circuit breaker.

We claim as our invention:

1. A circuit breaker comprising:

a stationary contact;

a movable contact operable between open and closed positions with respect to said stationary contact;

a movable contact holder coupled to, and movable with, said movable contact;

means for effecting movement of said movable contact between said open and closed positions including a rotatable drive shaft;

indicator means, mounted on but independently movable from said drive shaft, operable between first and second positions for indicating the position of said movable contact with respect to said stationary contact, said indicator means being in said first position when said movable contact is in said closed position and said indicator means being in said second position when said movable contact is in said open position;

biasing means for biasing said indicator means in said first position; and connection means operable between third and fourth positions for moving said indicator means from said first to said second positions, movement of said connection means from said third position to said fourth position moving said indicator means from said first position to said second position, said contact holder contacting said connection means upon movement of said movable contact from said closed to said open position and moving said connection means from said third to said fourth position.

2. The circuit breaker according to claim 1 wherein said indicator means are pivotally movable between said first and second positions.

3. The circuit breaker according to claim 1 wherein said connection means are pivotally movable between said third and fourth positions.

4. The circuit breaker according to claim 1 wherein, upon movement of said movable contact from said open to said closed position, said biasing means move said indicator means from said second to said first position, movement of said indicator means from said second to said first position moving said connection means from said fourth to said third position.

5. The circuit breaker according to claim 1 wherein said movement effecting means includes toggle means engaging said contact holder for moving said movable contact between said open and closed positions, said toggle means being in toggle position when said movable contact is in said closed position, and releasable toggle latch means for holding said toggle means in said toggle position, said toggle latch means including reset means for resetting said toggle latch means when said toggle latch means are released, said reset means extending outwardly from said toggle latch means upon release of said toggle latch means; and, a movable reset bracket is secured to, and movable with, said indicating means, said reset bracket, upon movement of said indicating means from said first to said second position, engaging said reset means and causing activation thereof.

6. The circuit breaker according to claim 5 wherein said toggle latch means comprises an electromechanical tripping device having a reset button extending outwardly therefrom upon release of said toggle latch means, said reset bracket engaging said reset button.

7. The circuit breaker according to claim 6 wherein said electromechanical tripping device is a flux transfer shunt trip activated by preselected conditions of said stationary contact.

8. A circuit breaker comprising:

a stationary contact;

a movable contact operable between open and closed positions with respect to said stationary contact;

a movable contact holder coupled to, and movable with, said movable contact;

means for effecting movement of said movable contact between said open and closed positions including toggle means engaging said contact holder for moving said movable contact between said open and closed positions, said toggle means being in toggle position when said movable contact is in said closed position, and releasable toggle latch means for holding said toggle means in said toggle position, said toggle latch means including reset means for resetting said toggle latch means when said toggle latch means are released, said reset means extending outwardly from said toggle latch means upon release of said toggle latch means;

indicator means operable between first and second positions for indicating the position of said movable contact with respect to said stationary contact, said indicator means being in said first position when said movable contact is in said closed position and said indicator means being in said second position when said movable contact is in said open position;

a movable reset bracket secured to, and movable with, said indicator means, said reset bracket, upon movement of said indicator means from said first and to said second position, engaging said reset means and causing activation thereof;

biasing means for biasing said indicator means in said first position; and connection means operable between third and fourth positions for moving said indicator means from said first to said second positions, movement of said connection means from said third position to said fourth position moving said indicator means from said first position to said second position, said contact holder contacting said connection means upon movement of said movable contact from said closed to said open position and moving said connection means from said third to said fourth position.

9. The circuit breaker according to claim 8 wherein said toggle latch means comprises an electromechanical tripping device having a reset button extending outwardly therefrom upon release of said toggle latch means, said reset bracket engaging said reset button.

10. The circuit breaker according to claim 9 wherein said electromechanical tripping device is a flux transfer shunt trip activated by preselected conditions of said stationary contact.

* * * * *